US011777258B2

(12) United States Patent
Tan et al.

(10) Patent No.: US 11,777,258 B2
(45) Date of Patent: Oct. 3, 2023

(54) ELECTRICAL CONNECTION DEVICE

(71) Applicant: Molex, LLC, Lisle, IL (US)

(72) Inventors: Hien-Hwee Tan, Jurong Town (SG); Ser-Kiat Toh, Jurong Town (SG)

(73) Assignee: Molex, LLC, Lisle, IL (US)

( * ) Notice: Subject to any disclaimer, the term of this patent is extended or adjusted under 35 U.S.C. 154(b) by 58 days.

(21) Appl. No.: 17/517,672

(22) Filed: Nov. 3, 2021

(65) Prior Publication Data

US 2022/0149568 A1 May 12, 2022

(30) Foreign Application Priority Data

Nov. 6, 2020 (CN) ..... 202011231294.0

(51) Int. Cl.

| | |
|---|---|
| ***H01R 13/64*** | (2006.01) |
| ***H01R 13/6471*** | (2011.01) |
| ***H01R 13/629*** | (2006.01) |
| ***H01R 12/58*** | (2011.01) |
| ***H01R 13/516*** | (2006.01) |
| ***H01R 13/24*** | (2006.01) |

(52) U.S. Cl.

CPC ..... *H01R 13/6471* (2013.01); *H01R 12/58* (2013.01); *H01R 13/2407* (2013.01); *H01R 13/516* (2013.01); *H01R 13/629* (2013.01)

(58) Field of Classification Search

CPC ..... H01R 13/6471; H01R 12/58; H01R 13/2407; H01R 13/516; H01R 13/629; H01R 13/2442; H01R 13/502; H01R 12/707; H01R 12/716; H01R 13/405; H01R 13/41; H01R 12/57; H01R 13/113; H01R 13/04; H01R 13/652; H01R 24/00; H01R 4/02

See application file for complete search history.

(56) References Cited

U.S. PATENT DOCUMENTS

| | | | | |
|---|---|---|---|---|
| 5,716,239 A | | 2/1998 | Olson | |
| 6,113,412 A | | 9/2000 | Lin | |
| 7,955,095 B1 | * | 6/2011 | Yang | H01R 12/57 439/83 |

(Continued)

FOREIGN PATENT DOCUMENTS

| | | | | |
|---|---|---|---|---|
| CN | 1604396 A | | 4/2005 | |
| CN | 202405536 | * | 8/2012 | H01R 13/2442 |

(Continued)

*Primary Examiner* — Truc T Nguyen

(57) ABSTRACT

A receptacle connector includes a receptacle housing and a plurality of receptacle terminals. The receptacle housing has a bottom surface, a top surface and a plurality of terminal grooves that each includes a first side wall portion, a second side wall portion and a top wall portion, and the top wall portion and the second side wall portion help define an insertion opening portion. Each receptacle terminal has a fixed segment which is fixed to the receptacle housing, an elastic segment which extends obliquely and upwardly from a top end of the fixed segment, then is folded back and extends obliquely and upwardly toward the top wall portion and a tail segment which extends toward the second side wall portion. The elastic segment has a contact portion which is positioned below the insertion opening portion and a guiding surface which is positioned below the insertion opening portion.

21 Claims, 18 Drawing Sheets

(56) References Cited

U.S. PATENT DOCUMENTS

| | | | | |
|---|---|---|---|---|
| 11,251,554 | B1 * | 2/2022 | Tan | H01R 12/716 |
| 2005/0009385 | A1 * | 1/2005 | Korsunsky | H01R 13/41 439/83 |
| 2005/0245121 | A1 | 11/2005 | Lin | |
| 2009/0227143 | A1 * | 9/2009 | Ichimiya | H01R 12/716 439/620.15 |
| 2010/0330844 | A1 * | 12/2010 | Ito | H01R 12/716 439/660 |
| 2013/0183861 | A1 * | 7/2013 | Chang | H01R 12/714 439/607.35 |
| 2013/0237091 | A1 * | 9/2013 | Mason | H01R 13/6585 439/607.05 |
| 2014/0038438 | A1 * | 2/2014 | Chang | H05K 7/1069 439/76.1 |
| 2014/0242817 | A1 * | 8/2014 | Mongold | H01R 13/02 439/83 |
| 2019/0190173 | A1 * | 6/2019 | Hwang | H01R 13/639 |
| 2020/0106203 | A1 * | 4/2020 | Hwang | H01R 13/41 |
| 2021/0075178 | A1 * | 3/2021 | Hwang | H01R 13/506 |
| 2022/0149568 | A1 * | 5/2022 | Tan | H01R 13/516 |
| 2022/0209446 | A1 * | 6/2022 | Ito | H01R 12/707 |
| 2022/0216634 | A1 * | 7/2022 | Liao | H01R 12/7076 |
| 2022/0320776 | A1 * | 10/2022 | Yang | H01R 24/60 |
| 2022/0336986 | A1 * | 10/2022 | Li | H01R 13/11 |
| 2022/0352660 | A1 * | 11/2022 | Yamada | H01R 12/7023 |
| 2022/0368078 | A1 * | 11/2022 | Murakami | H01R 13/50 |
| 2022/0384976 | A1 * | 12/2022 | Hsu | H01R 13/514 |

FOREIGN PATENT DOCUMENTS

| | | | | |
|---|---|---|---|---|
| CN | 111028914 | * | 1/2020 | H01R 13/41 |
| TW | I599124 B | | 9/2017 | |

* cited by examiner

ELECTRICAL CONNECTION DEVICE

RELATED APPLICATIONS

This application claims priority to Chinese Patent Application No. 202011231294.0, filed Nov. 6, 2020, which is incorporated herein by reference in its entirety.

TECHNICAL FIELD

The present disclosure relates to an electrical connection device, and particularly relates to an electrical connection device which has a lower height and is adapted to high speed transmission.

BACKGROUND

At present, an electronic information product is toward lightness in weight and thinness in volume and due to large amount of information, needs to conform with the requirement on rapid transmission speed. In the electronic information product, an electrical connector generally plays an important role in signal transmission. Because the electronic information product needs to be lightness in weight and thinness in volume, the electrical connector is necessary to lower a height thereof, so as to decrease a space occupied by the electrical connector in a casing of the electronic information product.

How to make the electrical connector lower the height thereof (for example, a height of the electrical connector is lower than 5 mm) and capable of conforming to an electrical requirement on high-speed transmission (for example, conforming to 112 GHz transmission speed requirement) still needs to be improved.

SUMMARY

Therefore, one of objects of the present disclosure is to provide an electrical connection device which has a lower height and can meet electrical requirement on high-speed transmission.

Accordingly, in some embodiments, an electrical connection device of the present disclosure comprises a receptacle connector. The receptacle connector comprises a receptacle housing and a plurality of receptacle terminals. The receptacle housing has a bottom surface, a top surface opposite to the bottom surface and a plurality of terminal grooves extending from the bottom surface toward the top surface, a groove wall defining each terminal groove comprises a first side wall portion and a second side wall portion which face each other and a top wall portion which extends from the first side wall portion toward the second side wall portion, and the top wall portion and the second side wall portion are spaced apart from each other to allow the terminal groove to form an insertion opening portion exposed on the top surface. The plurality of receptacle terminals are respectively provided in the plurality of terminal grooves, each receptacle terminal has a fixed segment which is fixed to the receptacle housing and is close to the bottom surface and the first side wall portion, an elastic segment which extends obliquely and upwardly from a top end of the fixed segment, then is folded back and extends obliquely, upwardly and straightly toward the top wall portion and a tail segment which extends from a bottom end of the fixed segment toward the second side wall portion. A tip end of the elastic segment is positioned below the top wall portion, the elastic segment has a contact portion which is formed at a position where the elastic segment is folded back and a guiding surface which is positioned between the contact portion and the tip end of the elastic segment and is positioned below the insertion opening portion.

In some embodiments, the receptacle housing further has a plurality of positioning walls which protrude from the bottom surface respectively corresponding to the plurality of terminal grooves, each positioning wall is provided along a circumferential side of the tail segment of the correspond receptacle terminal.

In some embodiments, the tail segment has a soldering surface which faces downwardly and is used to be soldered with a solder.

In some embodiments, the soldering surface is a concave arc surface and the solder is a tin ball, the soldering surface and a surface shape of the tin ball are matched with each other.

In some embodiments, in each receptacle terminal, a width of the fixed segment is larger than a width of the tail segment, and the tail segment extends from a middle of the bottom end of the fixed segment, the fixed segment has two notches which are recessed inwardly from the bottom end of the fixed segment respectively correspondingly to two sides of the tail segment.

In some embodiments, the contact portion presses against the second side wall portion.

In some embodiments, the electrical connection device further comprises a plug connector which is used to mate with the receptacle connector, the plug connector comprise a plug housing and a plurality of plug terminals provided to the plug housing, the plurality of plug terminals and the plurality of receptacle terminals correspond to each other, the insertion opening portion of the receptacle connector is used to allow the plug terminal to insert therein to limit the plug terminal, so that in an inserting process of the plug terminal, a tip end of the plug terminal pushes the guiding surface of the corresponding receptacle terminal to make the contact portion of the corresponding receptacle terminal move toward a direction away from the second side wall portion, in turn make the contact portion of the corresponding receptacle terminal abut against the plug terminal.

In some embodiments, the plurality of plug terminals are divided into multiple plug terminal groups, each plug terminal group is composed of three plug terminals, the two plug terminals of the three plug terminals are signal terminals and the other one plug terminal of the three plug terminals is a ground terminal, the ground terminal has two guiding connection portions which are respectively positioned at two sides of the two signal terminals and a connecting portion which connects the two guiding connection portions, the plurality of receptacle terminals are divided into multiple receptacle terminal groups which respectively correspond to the multiple plug terminal groups, each receptacle terminal group is composed of four receptacle terminals arranged side by side, the two receptacle terminals positioned in a middle of the four receptacle terminals respectively mate with the two corresponding signal terminals and the two receptacle terminals positioned at two sides of the four receptacle terminals respectively mate with the two guiding connection portions of the corresponding ground terminal, the plurality of terminal grooves are divided into multiple terminal groove groups corresponding to the multiple receptacle terminal groups, the receptacle housing further has multiple insertion grooves respectively provided corresponding to the multiple terminal groove groups to allow the connecting portions of the ground terminals of the multiple receptacle terminal groups to insert therein respectively.

In some embodiments, the second side wall portion has an inner taper segment which is positioned below the corresponding contact portion and extends to the bottom surface.

In some embodiments, the plurality of receptacle terminal are divided into multiple receptacle terminal groups, each receptacle terminal group is composed of four receptacle terminals arranged side by side, the two receptacle terminals positioned at a middle of the four receptacle terminals are signal terminals, and the two receptacle terminals respectively positioned at outer sides of the four receptacle terminals are ground terminals, the elastic segments of the two signal terminals in each receptacle terminal group are spaced apart from each other by a first distance, the elastic segment of the signal terminal and the elastic segment of the ground terminal in the signal terminal and the ground terminal which are adjacent to each other in each receptacle terminal group are spaced apart from each other by a second distance, and the first distance is smaller than the second distance, the tail segments of the two signal terminals in each receptacle terminal group are spaced apart from each other by a third distance, the tail segment of the signal terminal and the tail segment of the ground terminal in the signal terminal and the ground terminal which are adjacent to each other in each receptacle terminal group are spaced apart from each other by a fourth distance, and the third distance is larger than the fourth distance.

In some embodiments, the plurality of receptacle terminals are divided into multiple receptacle terminal groups, each receptacle terminal group is composed of four receptacle terminals arranged side by side, the two receptacle terminals positioned at a middle of the four receptacle terminals are signal terminals, and the two receptacle terminals respectively positioned at outer sides of the four receptacle terminals are ground terminals, the plurality of terminal grooves are divided into multiple terminal groove groups, each terminal groove group is composed of four terminal grooves arranged side by side and correspondingly receives one of the multiple receptacle terminal groups, the two terminal grooves in each terminal groove group which are used to respectively receive the two signal terminals of the corresponding receptacle terminal group are spaced apart from each other by a fifth distance, the two terminal grooves in each terminal groove group which are used to receive the signal terminal and the ground terminal which are adjacent to each other in the corresponding receptacle terminal group are spaced apart from each other by a sixth distance, and the fifth distance is smaller than the sixth distance.

In some embodiments, an electrical connection device of the present disclosure comprises a receptacle connector. The receptacle connector comprises a receptacle housing and multiple terminal blocks. The receptacle housing has a bottom surface, a top surface opposite to the bottom surface and multiple terminal groove groups, each terminal groove group comprises a receiving groove which is recessed from the bottom surface and terminal grooves which are communicated with the receiving groove and extend toward the top surface, a groove wall defining each terminal groove comprises a first side wall portion and a second side wall portion which face each other and a top wall portion which extends from the first side wall portion toward the second side wall portion, and the top wall portion and the second side wall portion are spaced apart from each other to allow the terminal groove to form an insertion opening portion exposed on the top surface. The multiple terminal blocks are respectively provided in the multiple terminal groove groups, each terminal block comprises an insulative base and receptacle terminals, the insulative base is provided to the receiving groove of the corresponding terminal groove group. Each receptacle terminal is provided corresponding to one of the terminal grooves and has a fixed segment which is fixed to the insulative base and is close to the first side wall portion, an elastic segment which extends obliquely and upwardly from a top end of the fixed segment, then is folded back and extends obliquely and upwardly toward the top wall portion and a tail segment which extends from a bottom end of the fixed segment toward the second side wall portion. A tip end of the elastic segment is positioned below the top wall portion, the elastic segment has a contact portion which is formed at a position where the elastic segment is folded back and a guiding surface which is positioned between the contact portion and the tip end of the elastic segment and is positioned below the insertion opening portion.

In some embodiments, the tail segment has a soldering surface which faces downwardly and is used to be soldered with a solder.

In some embodiments, the soldering surface is a concave arc surface and the solder is a tin ball, the soldering surface and a surface shape of the tin ball are matched with each other.

In some embodiments, in each receptacle terminal, a width of the fixed segment is larger than a width of the tail segment, and the tail segment extends from a middle of the bottom end of the fixed segment, the fixed segment has two notches which are recessed inwardly from the bottom end of the fixed segment respectively correspondingly to two sides of the tail segment.

In some embodiments, the contact portion presses against the second side wall portion.

In some embodiments, the electrical connection device further comprises a plug connector which is used to mate with the receptacle connector, the plug connector comprises a plug housing and a plurality of plug terminals provided to the plug housing, the plurality of plug terminals and the receptacle terminals correspond to each other, the insertion opening portion of the receptacle connector is used to allow the plug terminal to insert therein to limit the plug terminal, so that in an inserting process of the plug terminal, a tip end of the plug terminal pushes the guiding surface of the corresponding receptacle terminal to make the contact portion of the corresponding receptacle terminal move toward a direction away from the second side wall portion, in turn make the contact portion of the corresponding receptacle terminal abut against the plug terminal.

In some embodiments, the plurality of plug terminals are divided into multiple plug terminal groups, each plug terminal group is composed of three plug terminals, the two plug terminals of the three plug terminals are signal terminals and the other one plug terminal of the three plug terminals is a ground terminal, the ground terminal has two guiding connection portions which are respectively positioned at two sides of the two signal terminals and a connecting portion which connects the two guiding connection portions, the multiple terminal blocks respectively correspond to the multiple plug terminal groups, each terminal block has four receptacle terminals arranged side by side, the two receptacle terminals positioned in a middle of the four receptacle terminals respectively mate with the two corresponding signal terminals and the two receptacle terminals positioned at two sides of the four receptacle terminals respectively mate with the two guiding connection portions of the corresponding ground terminal, each terminal groove group further has an insertion groove to allow the connecting portion of the corresponding ground terminal to insert therein.

In some embodiments, each terminal block is formed by insert molding.

In some embodiments, each terminal block has four receptacle terminals arranged side by side, the two receptacle terminals positioned at a middle of the four receptacle terminals are signal terminals, and the two receptacle terminals respectively positioned at outer sides of the four receptacle terminals are ground terminals, the elastic segments of the two signal terminals in each terminal block are spaced apart from each other by a first distance, the elastic segment of the signal terminal and the elastic segment of the ground terminal in the signal terminal and the ground terminal which are adjacent to each other in each terminal block are spaced apart from each other by a second distance, and the first distance is smaller than the second distance, the tail segments of the two signal terminals in each terminal block are spaced apart from each other by a third distance, the tail segment of the signal terminal and the tail segment of the ground terminal in the signal terminal and the ground terminal which are adjacent to each other in each terminal block are spaced apart from each other by a fourth distance, and the third distance is larger than the fourth distance.

In some embodiments, each terminal block has four receptacle terminals arranged side by side, the two receptacle terminals positioned at a middle of the four receptacle terminals are signal terminals, and the two receptacle terminals respectively positioned at outer sides of the four receptacle terminals are ground terminals, each terminal groove group has four terminal grooves, the two terminal grooves in each terminal groove group which are used to respectively receive the two signal terminals of the corresponding terminal block are spaced apart from each other by a fifth distance, the two terminal grooves in each terminal groove group which are used to receive the signal terminal and the ground terminal which are adjacent to each other in the corresponding terminal block are spaced apart from each other by a sixth distance, and the fifth distance is smaller than the sixth distance.

The present disclosure at least has following effect: the receptacle connector wholly can meet a requirement on small-size and lower height and can conform to an electrical requirement on high-speed transmission (112 GHz).

BRIEF DESCRIPTION OF THE DRAWINGS

Other features and technical effects of the present disclosure will be apparent in an embodiment referring to the accompanying drawings, in which.

DETAILED DESCRIPTION OF THE PREFERRED EMBODIMENTS

Figure 1:
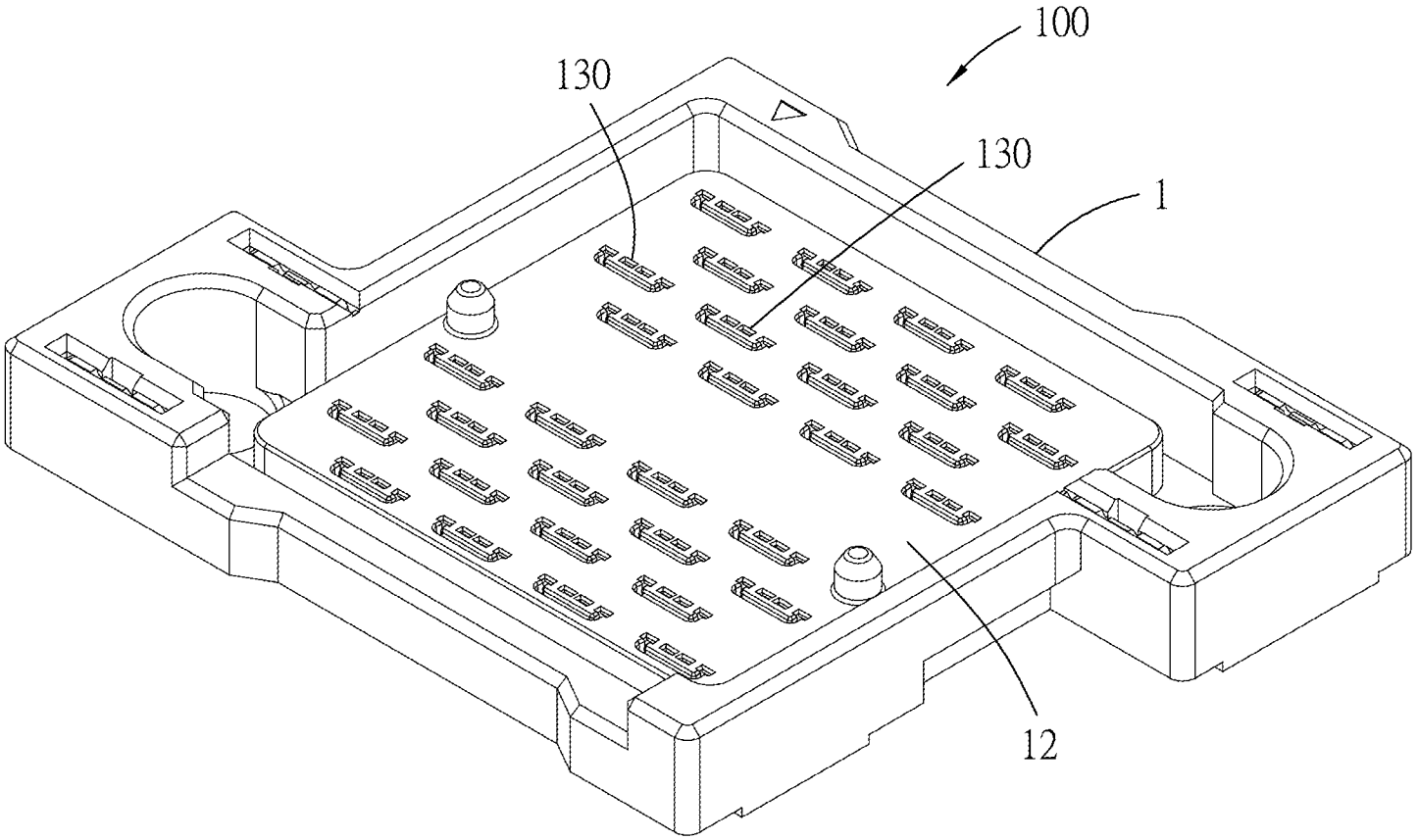
FIG. 1 is a perspective view of a first embodiment of a receptacle connector of an electrical connection device of the present disclosure.

Before the present disclosure is described in detail, it is noted that the similar components are indicated by the same reference numerals in the following description.

Figure 2:
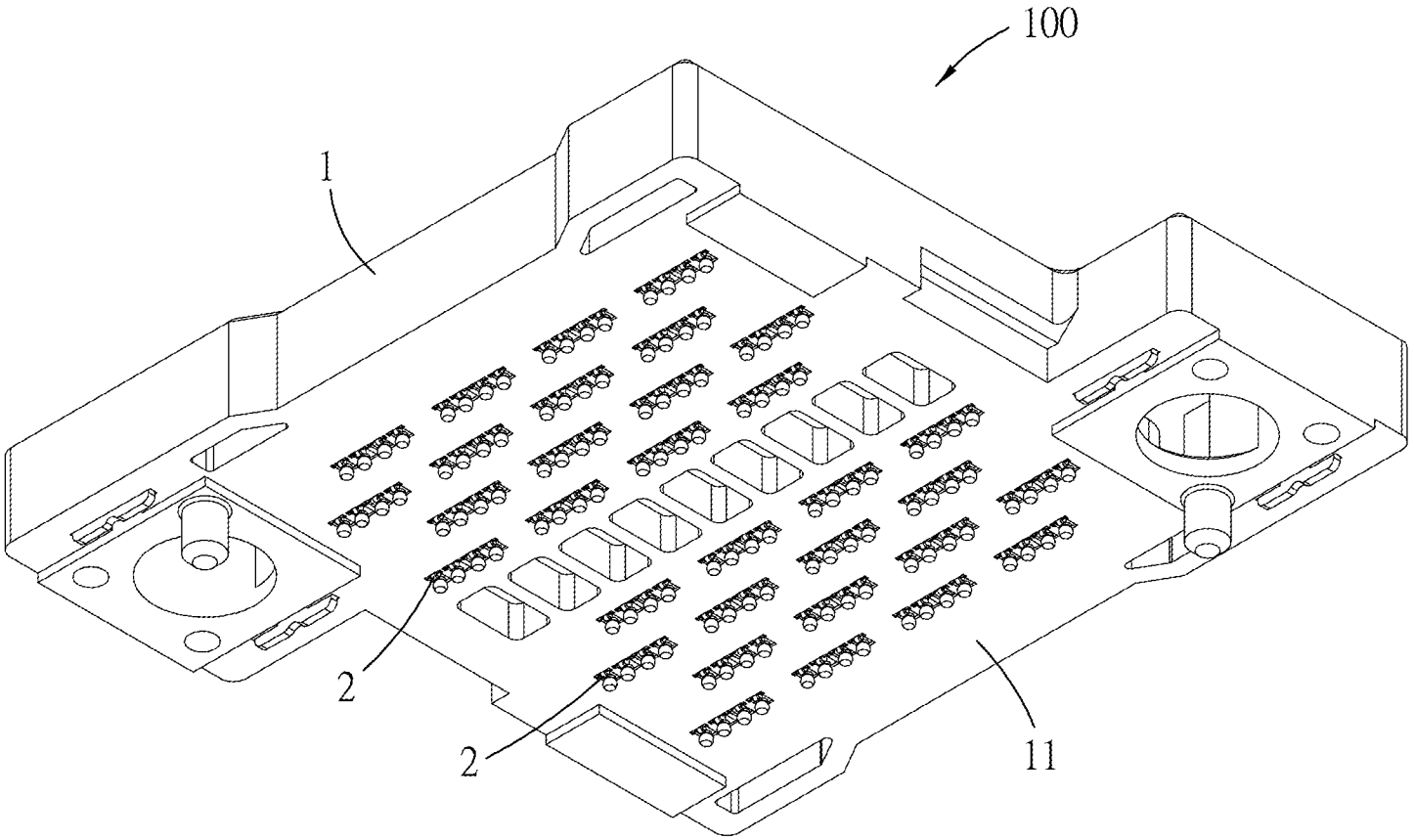
FIG. 2 is a perspective view of FIG. 1 from another angle.

Referring to FIG. 1 and FIG. 2, a first embodiment of an electrical connection device of the present disclosure includes a receptacle connector 100. The receptacle connector 100 includes a receptacle housing 1 and a plurality of receptacle terminals 2. In the present embodiment, a height of the receptacle connector 100 is less than 5 mm, and the receptacle connector 100 is a small-sized connector having a lower height.

Figure 3:
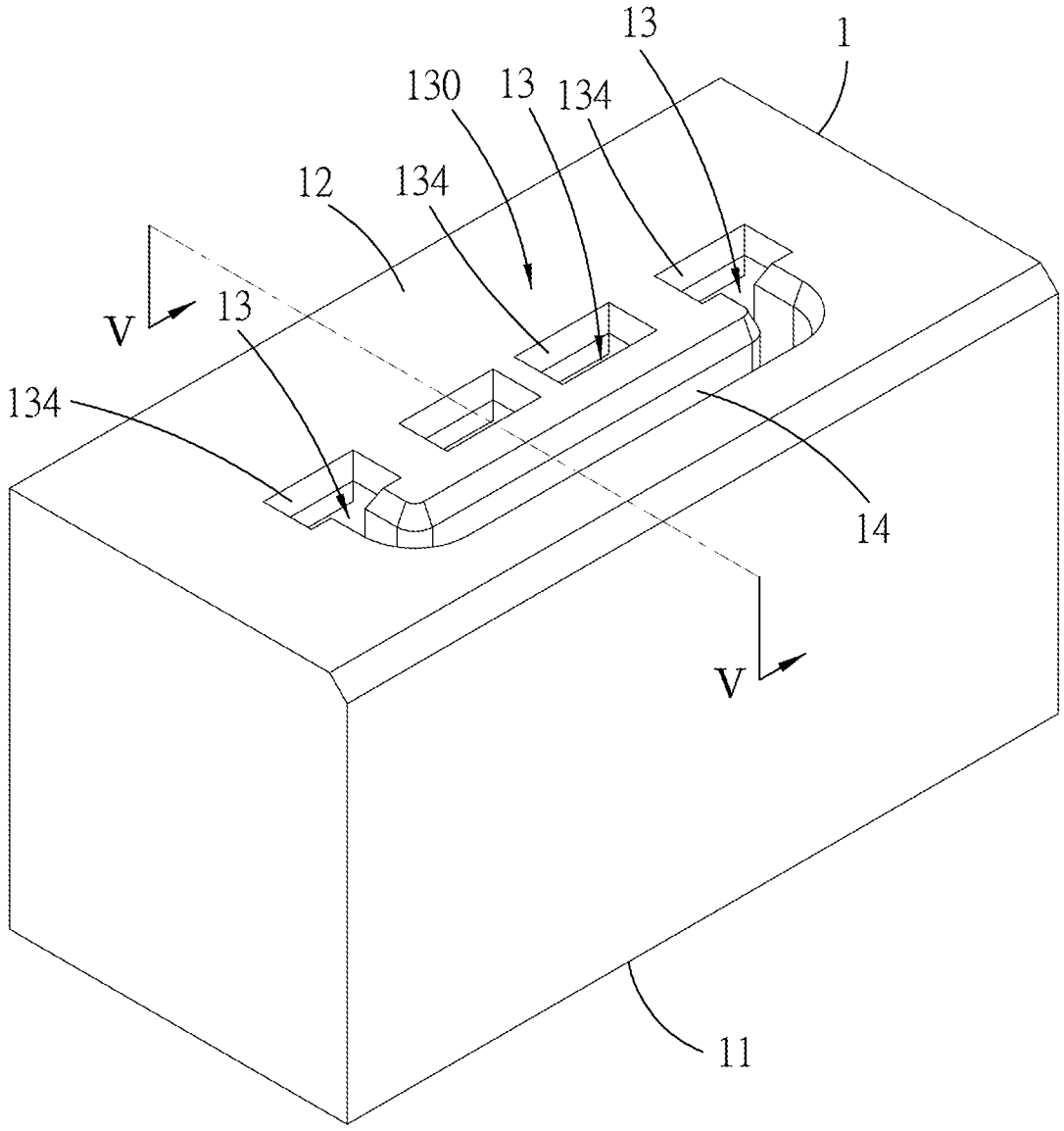
FIG. 3 is a partial perspective view of the first embodiment.
Figure 4:
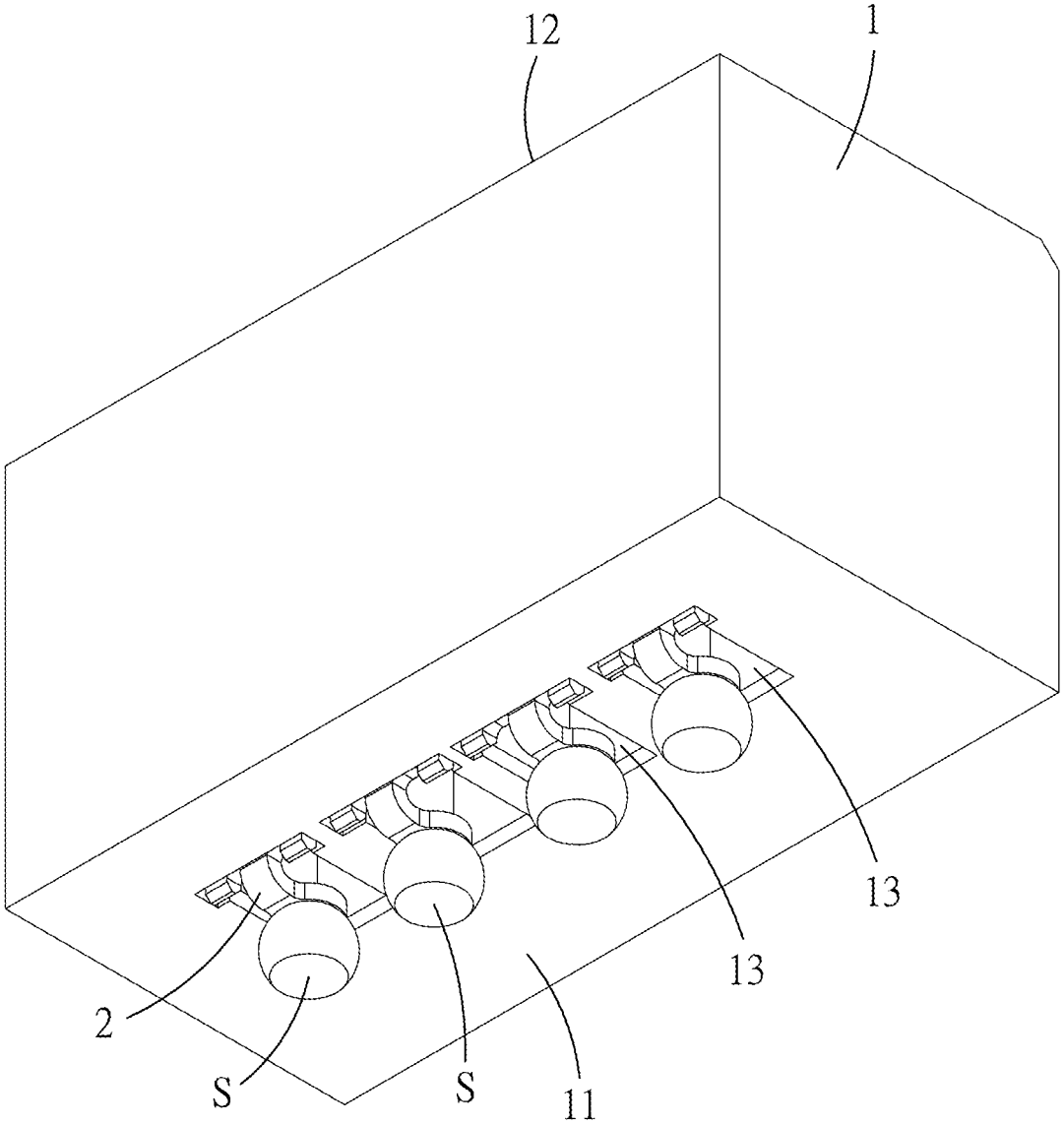
FIG. 4 is a perspective view of FIG. 3 from another angle.
Figure 5:
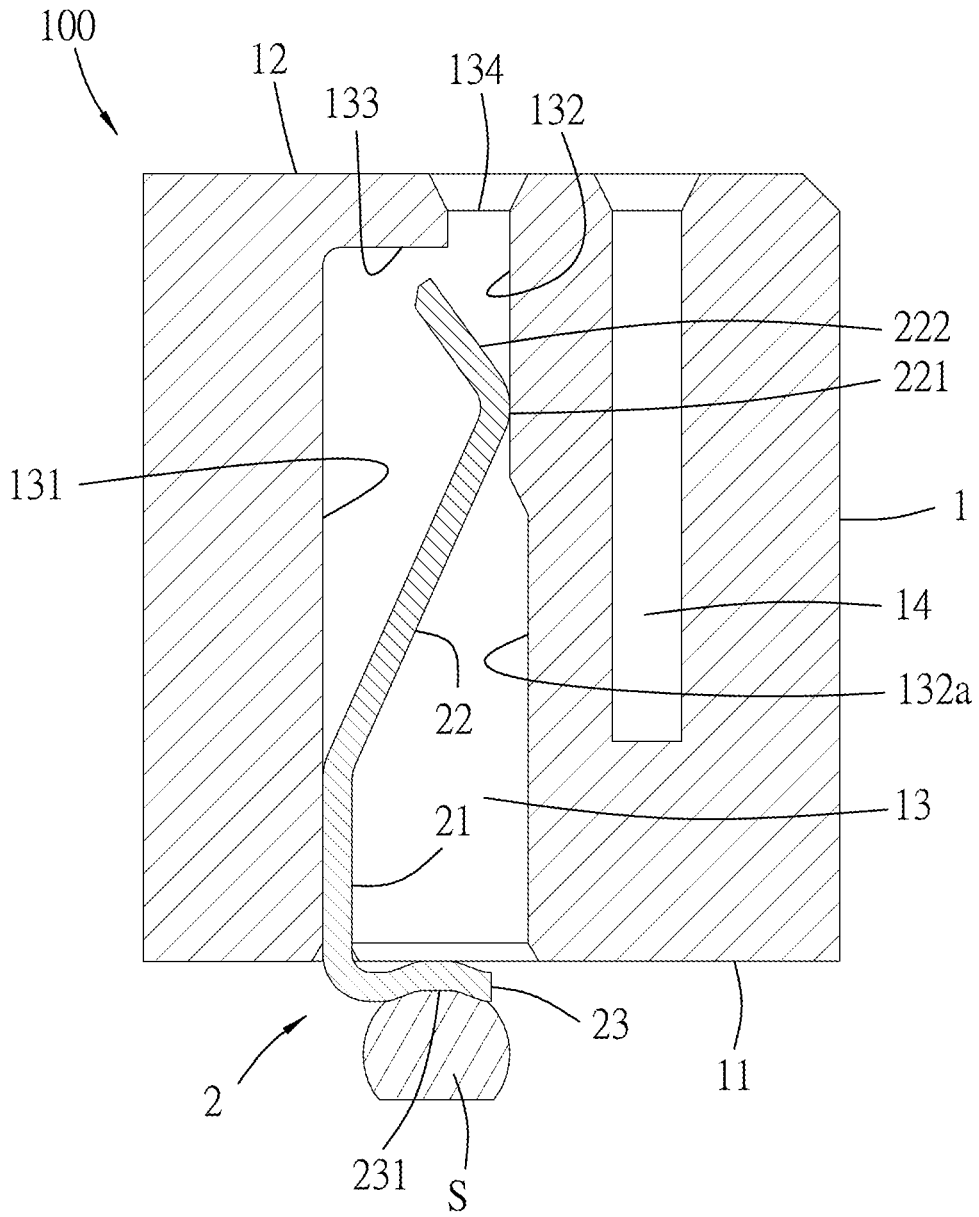
FIG. 5 is a cross sectional view taken along a line V-V of FIG. 3.

Referring to FIG. 3 to FIG. 5, the receptacle housing 1 has a bottom surface 11, a top surface 12 opposite to the bottom surface 11 and a plurality of terminal grooves 13 extending from the bottom surface 11 toward the top surface 12. A groove wall defining each terminal groove 13 includes a first side wall portion 131 and a second side wall portion 132 which face each other and a top wall portion 133 which extends from the first side wall portion 131 toward the second side wall portion 132, and the top wall portion 133 and the second side wall portion 132 are spaced apart from each other to allow the terminal groove 13 to form an insertion opening portion 134 exposed on the top surface 12. In the present embodiment, the plurality of terminal grooves 13 are divided into multiple terminal groove groups 130, specifically, each terminal groove group 130 is composed of four terminal grooves 13 arranged side by side. Moreover, in the present embodiment, the receptacle housing 1 further has multiple insertion grooves 14 respectively provided corresponding to the multiple terminal groove groups 130, that is to say, each terminal groove group 130 further includes an insertion groove 14, the insertion groove 14 is communicated with the two terminal grooves 13 which are respectively positioned at two outer sides of the four terminal grooves 13 and the two insertion opening portions 134 of the two terminal grooves 13 which are respectively positioned at the two outer sides of the four terminal grooves 13.

Figure 6:
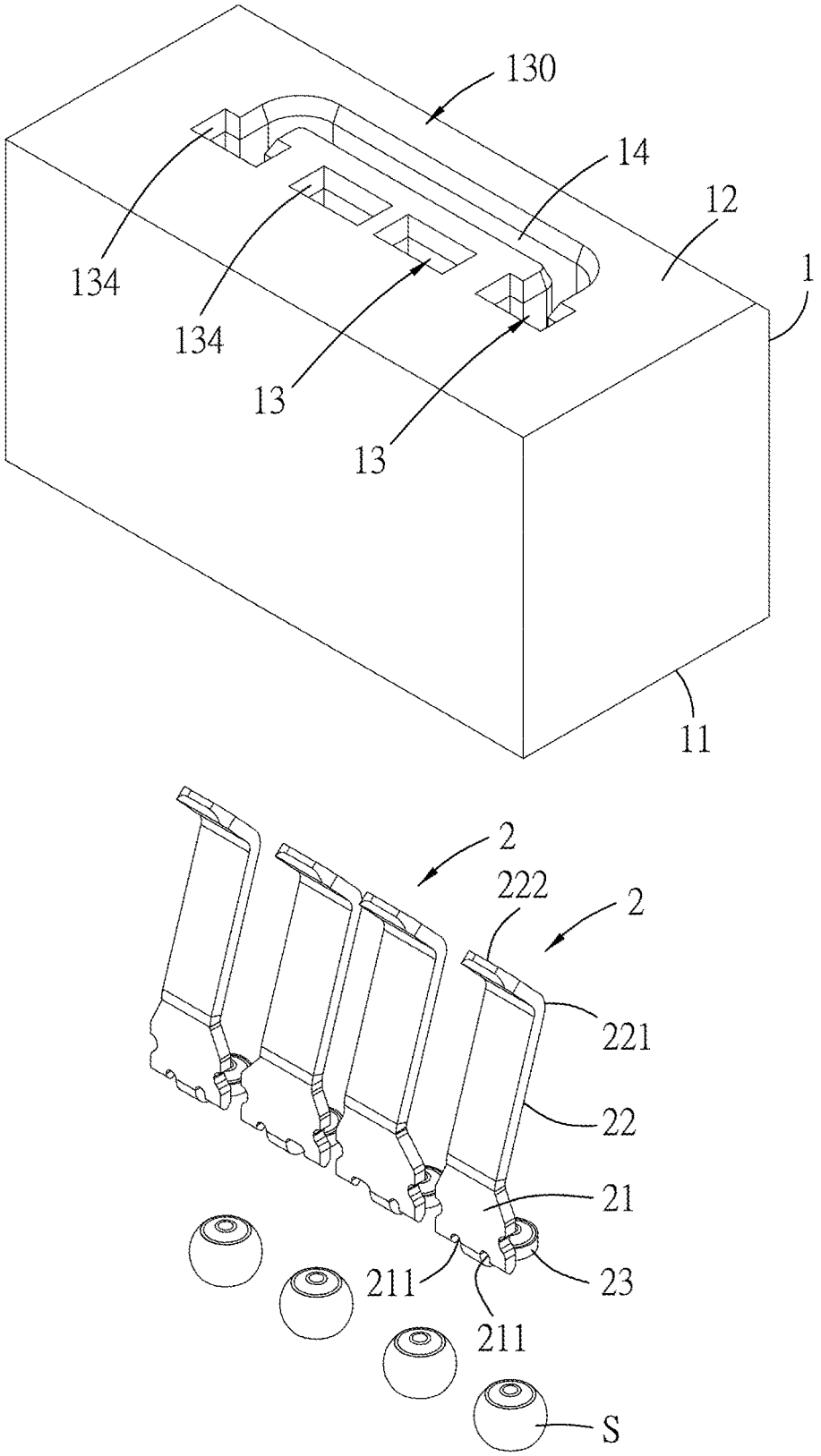
FIG. 6 is a partial perspective exploded view of the first embodiment.
Figure 7:
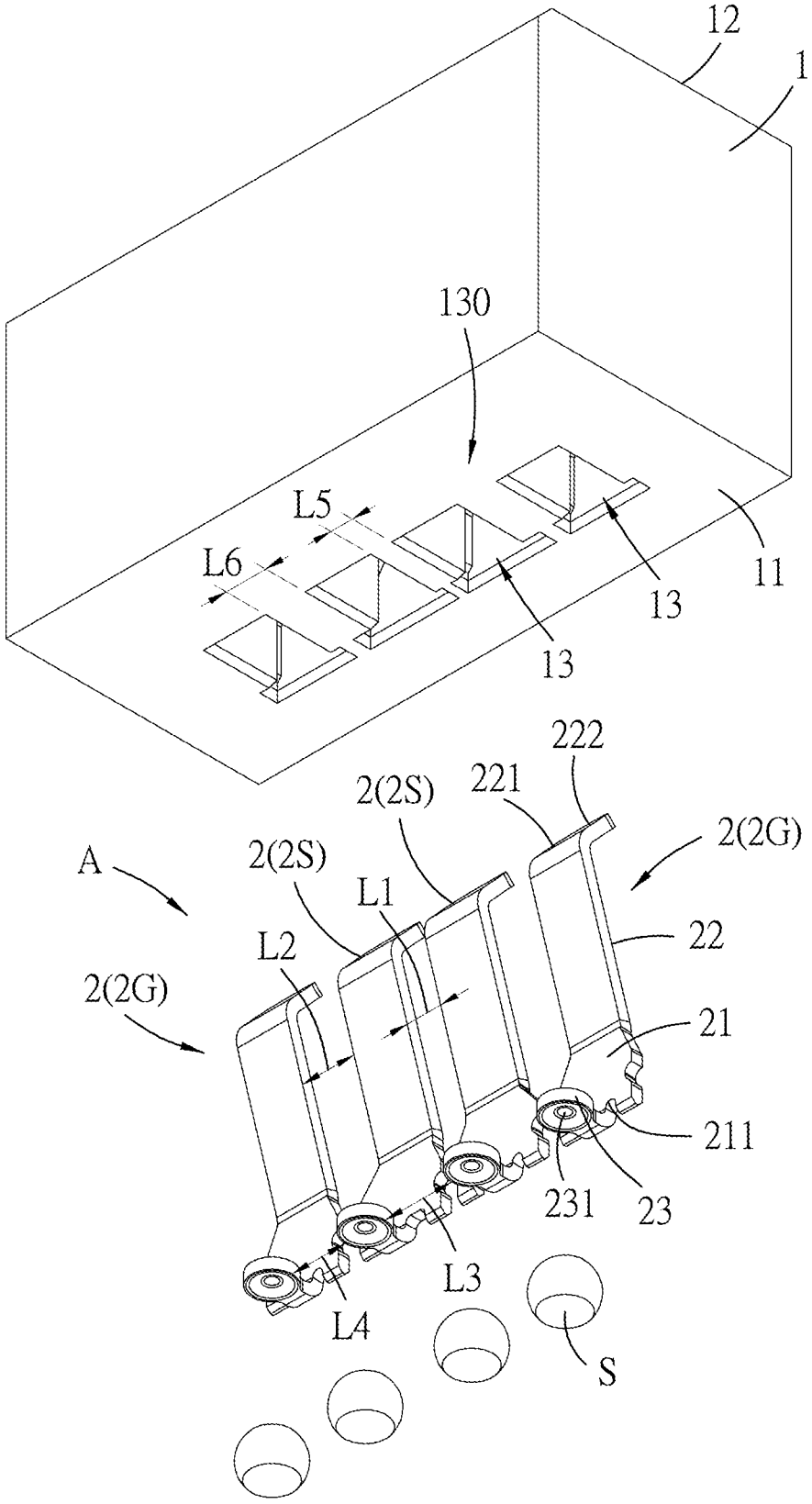
FIG. 7 is a perspective exploded view of FIG. 6 from another angle.

Referring to FIG. 5 to FIG. 7, the plurality of receptacle terminals 2 are respectively provided in the plurality of terminal grooves 13. Each receptacle terminal 2 has a fixed segment 21 which is fixed to the receptacle housing 1 and is close to the bottom surface 11 and the first side wall portion 131, an elastic segment 22 which extends obliquely, upwardly and straightly from a top end of the fixed segment 21 toward the second side wall portion 132, then is folded back and extends obliquely, upwardly and straightly toward the top wall portion 133, and a tail segment 23 which extends from a bottom end of the fixed segment 21 toward the second side wall portion 132. A tip end of the elastic segment 22 is positioned below the top wall portion 133 and the elastic segment 22 has a contact portion 221 which is formed at a position where the elastic segment 22 is folded back and which is positioned below the insertion opening portion 134 and a guiding surface 222 which is positioned between the contact portion 221 and the tip end of the elastic segment 22 and is positioned below the insertion opening portion 134. In the present embodiment, the contact portion 221 presses against the second side wall portion 132 and has a preloading force. The tail segment 23 has a soldering surface 231 which faces downwardly and is used to be soldered with a solder S. In the present embodiment, the soldering surface 231 is a concave arc surface and the solder S is a tin ball S, so that the soldering surface 231 and a surface shape of the tin ball S are matched with each other, which can pre-position the tin ball S first when the soldering surface 231 and the tin ball S are soldered with each other and can a better contact surfaces to be conveniently soldered.

In the present embodiment, the second side wall portion 132 has an inner taper segment 132*a* which is positioned below the contact portion 221 and extends to the bottom surface 11. By that the inner taper segment 132*a* is more away from the corresponding receptacle terminal 2, an influence that transmission speed of the receptacle terminal 2 becomes slower due to closing to the receptacle housing 1 which is insulative (plastic) is reduced, in turn signal integrity is promoted when a signal is transmitted. And, in the present embodiment, the plurality of receptacle terminals 2 are divided into multiple receptacle terminal groups A, each receptacle terminal group A is correspondingly provided to one of the multiple terminal groove groups 130. Each receptacle terminal group A is composed of four receptacle terminals 2 arranged side by side, the two receptacle terminals 2 positioned at a middle of the four receptacle terminals 2 are signal terminal 2S, and the two receptacle terminals 2 respectively positioned at outer sides of the four receptacle terminals 2 are ground terminals 2G. The elastic segments 22 of the two signal terminals 2S in each receptacle terminal group A are spaced apart from each other by a first distance L1, the elastic segment 22 of the signal terminal 2S and the elastic segment 22 of the ground terminal 2G in the signal terminal 2S and the ground terminal 2G which are adjacent to each other in each receptacle terminal group A are spaced apart from each other by a second distance L2, and the first distance L1 is smaller than the second distance L2. Moreover, the tail segments 23 of the two signal terminals 2S in each receptacle terminal group A are spaced apart from each other by a third distance L3, the tail segment 23 of the signal terminal 2S and the tail segment 23 of the ground terminal 2G in the signal terminal 2S and the ground terminal 2G which are adjacent to each other in each receptacle terminal group A are spaced apart from each other by a fourth distance L4, and the third distance L3 is larger than the fourth distance L4. The two terminal grooves 13 positioned at a middle of each terminal groove group 130 and used to respectively receive the two signal terminals 2S of the corresponding receptacle terminal group A are spaced apart from each other by a fifth distance L5, the two terminal grooves 13 of each terminal groove group 130 used to receive the signal terminal 2S and the ground terminal 2G which are adjacent to each other in the corresponding receptacle terminal group A are spaced apart from each other by a sixth distance L6, and the fifth distance L5 is smaller than the sixth distance L6. With such a configuration, signal integrity can further promoted when a signal is transmitted.

In the present embodiment, in each receptacle terminal, a width of the fixed segment 212 is larger than a width of the tail segment 23, and the tail segment 23 extends from a middle of the bottom end of the fixed segment 21, the fixed segment 21 has two notches 211 which are recessed inwardly from the bottom end of the fixed segment 21 respectively corresponding to two sides of the tail segment 23. By the notches 211, a bent location of the tail segment 23 can be closer to the fixed segment 21, which can lower a height of the receptacle terminal 2 and can increase an elasticity of the tail segment 23, that is, can increase elasticity adjusting capability of the tail segment 23 when the tail segment 23 is subject to an external force, so as to lower a risk that the tail segment 23 is fractured. In the present embodiment, a height of each receptacle terminal 2 is less than 2 mm.

Figure 8:
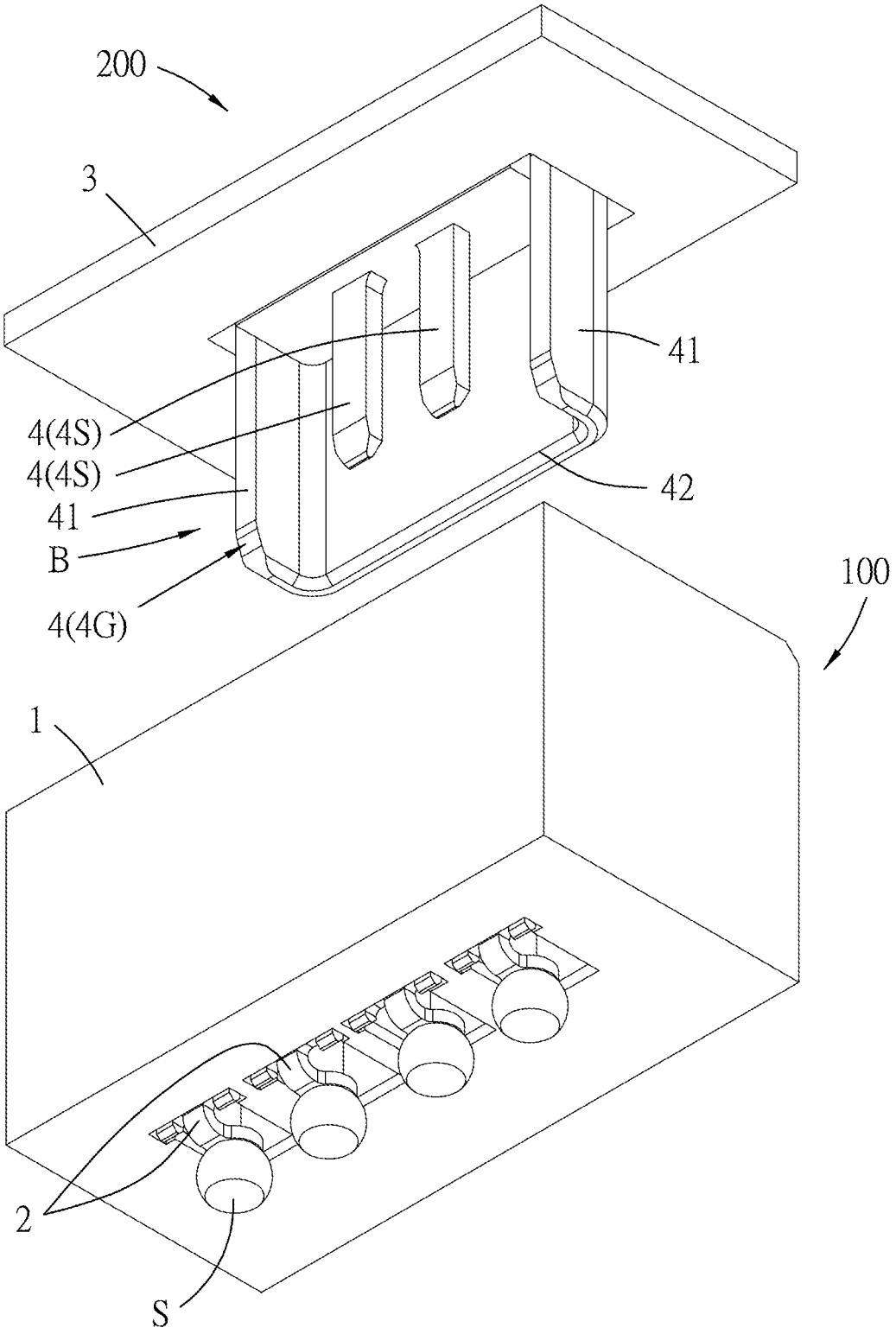
FIG. 8 is a partial perspective exploded view illustrating a mating relationship between the first embodiment of the receptacle connector and a plug connector.
Figure 9:
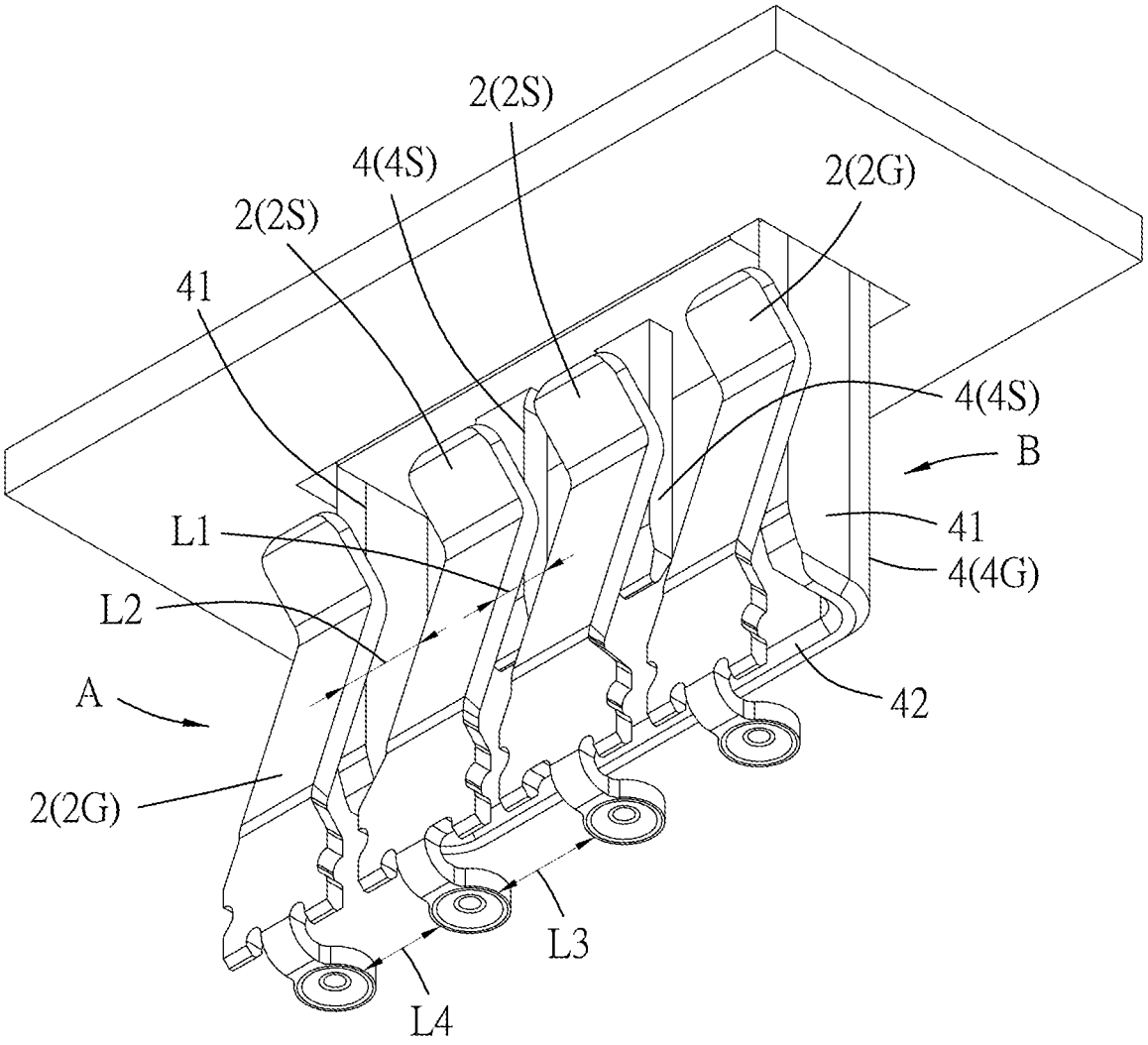
FIG. 9 is a partial perspective view illustrating a mating relationship between the first embodiment of the receptacle terminal and the plug terminal with a receptacle housing removed.
Figure 10:
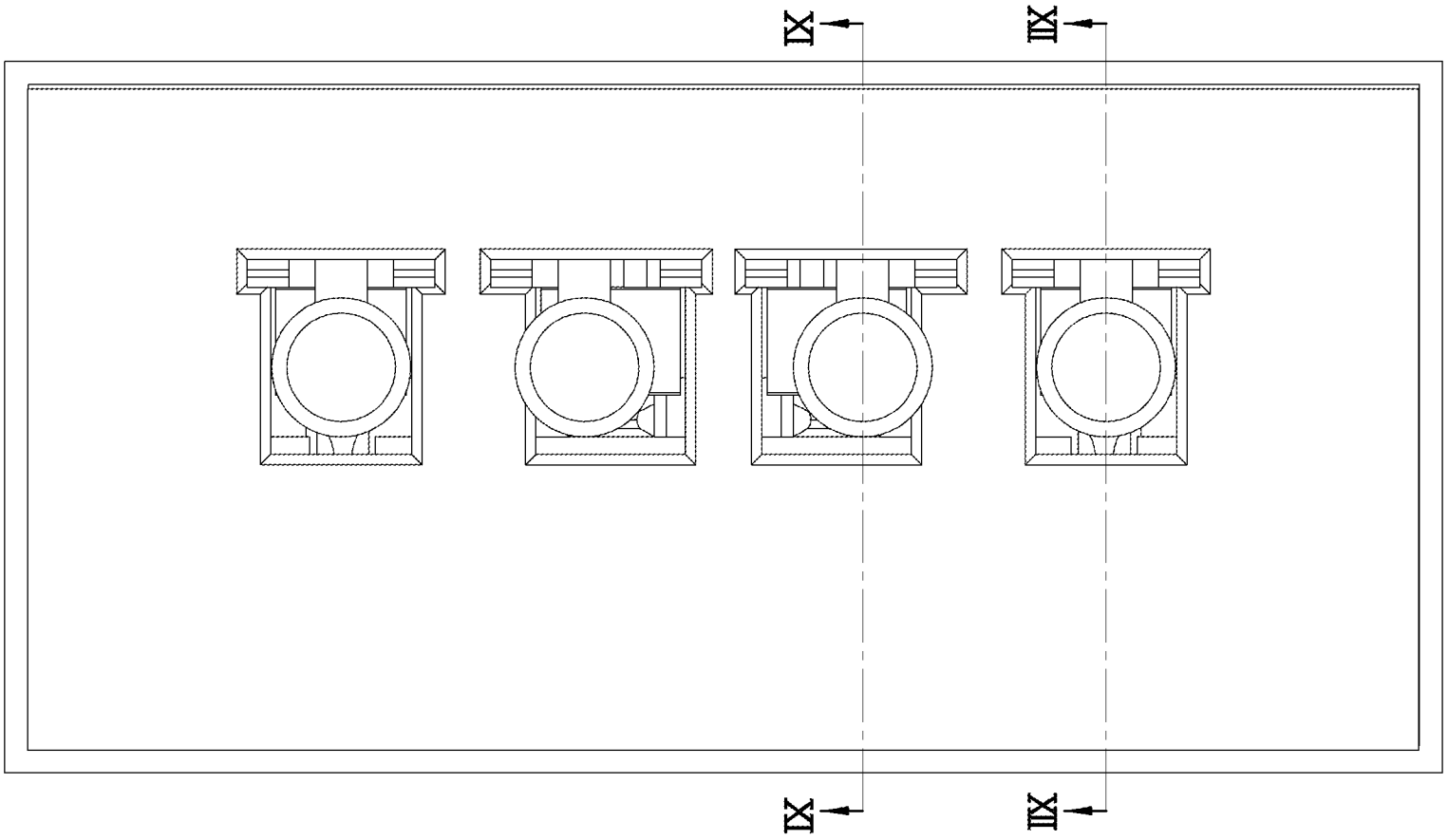
FIG. 10 is a partial bottom view of the first embodiment.
Figure 11:
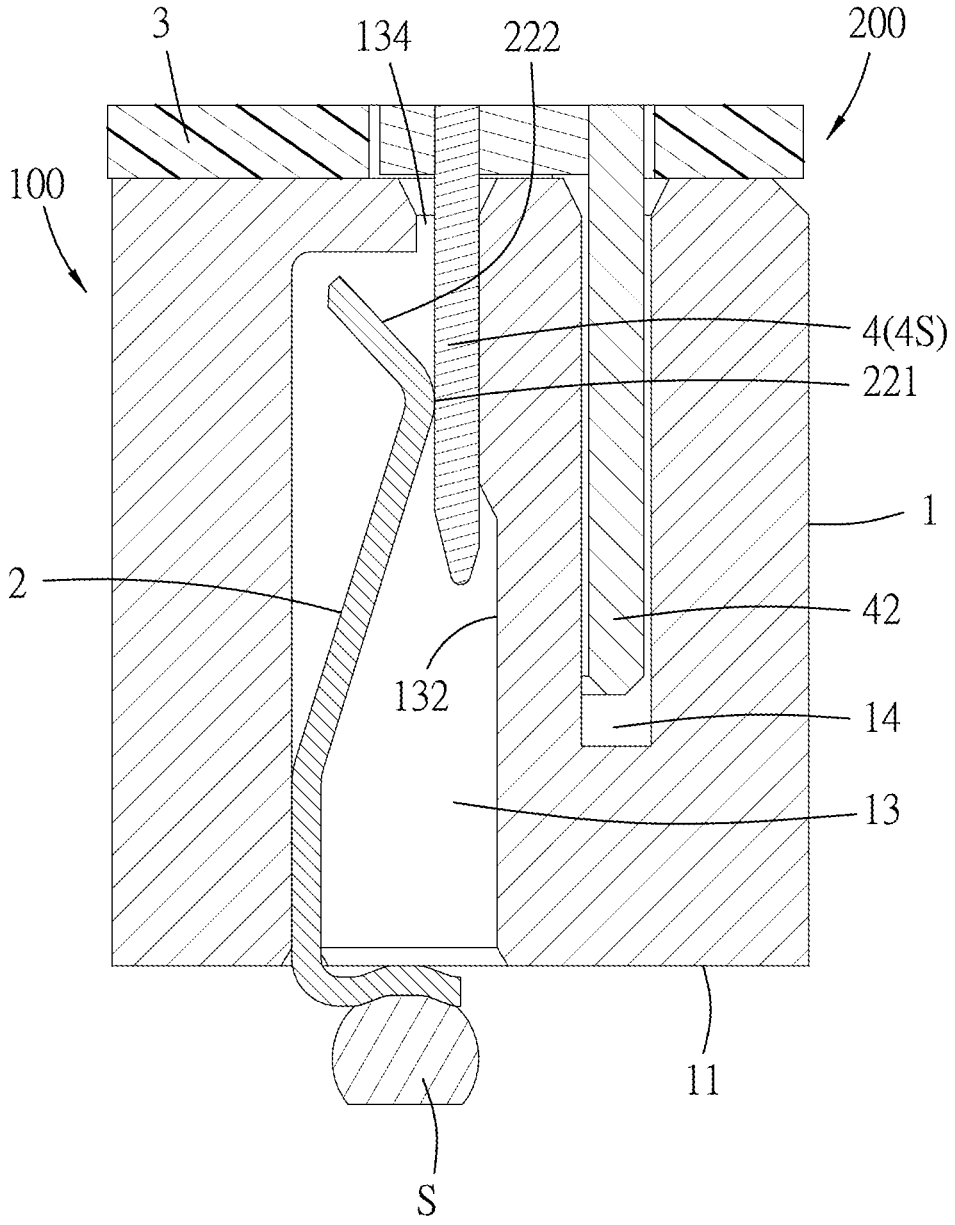
FIG. 11 is a cross sectional view taken along a line XI-XI of FIG. 10.
Figure 12:
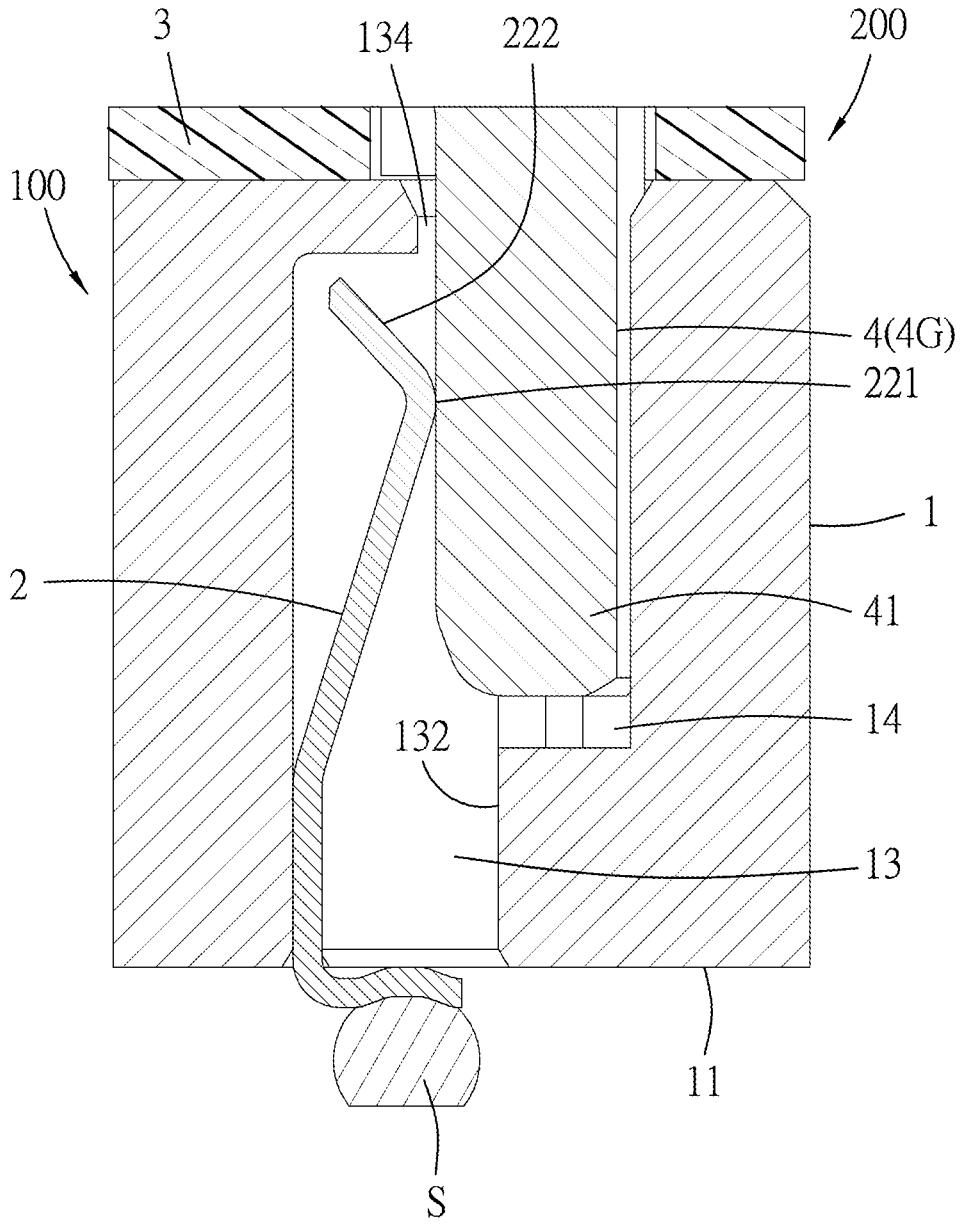
FIG. 12 is a cross sectional view taken along a line XII-XII of FIG. 10.

Referring to FIG. 8 and FIG. 9, in the present embodiment, the electrical connection device further includes a plug connector 200 which is used to mate with the receptacle connector 100, for sake of convenient description, only a part of the plug connector 200 is shown in the figures. The plug connector 200 includes a plug housing 3 and a plurality of plug terminals 4 provided to the plug housing 3, the plurality of plug terminals 4 and the plurality of receptacle terminals 2 correspond to each other. Referring to FIG. 10 to FIG. 12, the insertion opening portion 134 of the receptacle connector 100 is used to allow the plug terminal 4 to insert therein to limit the plug terminal 4, so that in an inserting process of the plug terminal 4, a tip end of the plug terminal 4 pushes the guiding surface 222 of the corresponding receptacle terminal 2 to make the contact portion 221 of the corresponding receptacle terminal 2 move toward a direction away from the second side wall portion 132, in turn make the contact portion 221 of the corresponding receptacle terminal 2 abut against the plug terminal 4. The contact portion 221 of the corresponding receptacle terminal 2 have the preloading force, can generate a larger normal force to contact the plug terminal 4 when the contact portion 221 of the corresponding receptacle terminal 2 abut against the plug terminal 4, thereby ensuring stability of electrical connection.

Again referring to FIG. 8 and FIG. 9, the plurality of plug terminals 4 are divided into multiple plug terminal groups B, only one plug terminal group B is shown in the figures. Each plug terminal group B is composed of three plug terminals 4, the two plug terminals 4 of the three plug terminals 4 are signal terminals 4S and the other one plug terminal 4 of the three plug terminals 4 is a ground terminal 4G. The ground terminal 4G has two guiding connection portions 41 which are respectively positioned at two sides of the two signal terminals 4S and a connecting portion 42 which connects the two guiding connection portions 41. The multiple receptacle terminal groups A respectively correspond to the multiple plug terminal groups B. The two signal terminals 2S positioned at a middle of each receptacle terminal group A respectively mate with the corresponding two signal terminals 4S and the two ground terminals 2G positioned at two sides of each receptacle terminal group A respectively mate with the two guiding connection portions 41 of the corresponding ground terminal 4G. Additionally in combination with referring to FIG. 6 and FIG. 11, the insertion groove 14 of each terminal groove group 130 is used to allow the connecting portion 42 of the ground terminal 4G to insert therein. By that the ground terminal 4G of each plug terminal group B forms a grounding structure having a large area through the two guiding connection portions 41 and the connecting portion 42, grounding efficacy can be increased, interference in signal high-speed transmission is lowered.

Figure 13:
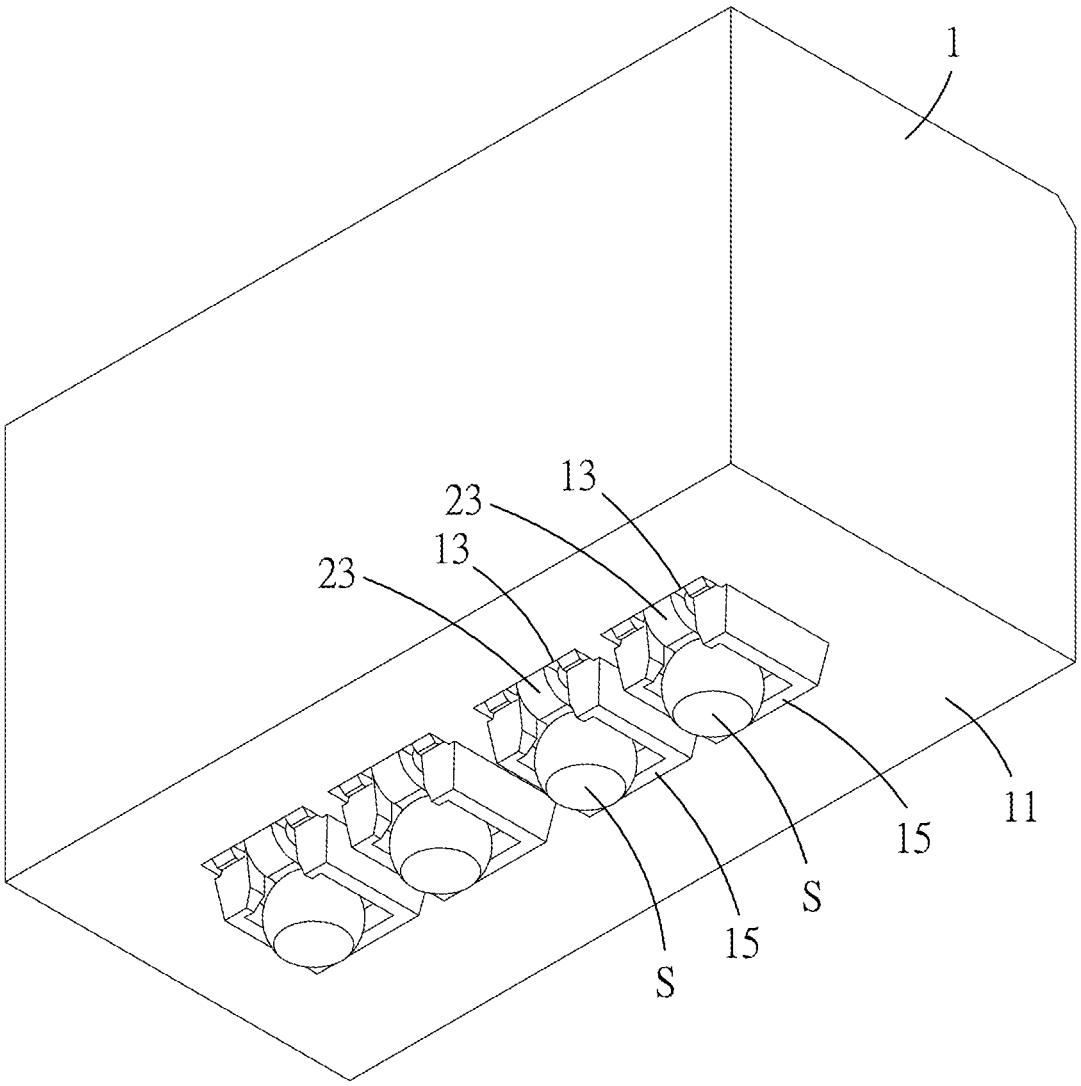
FIG. 13 is a partial perspective view of a second embodiment of the receptacle connector of the electrical connection device of the present disclosure.
Figure 14:
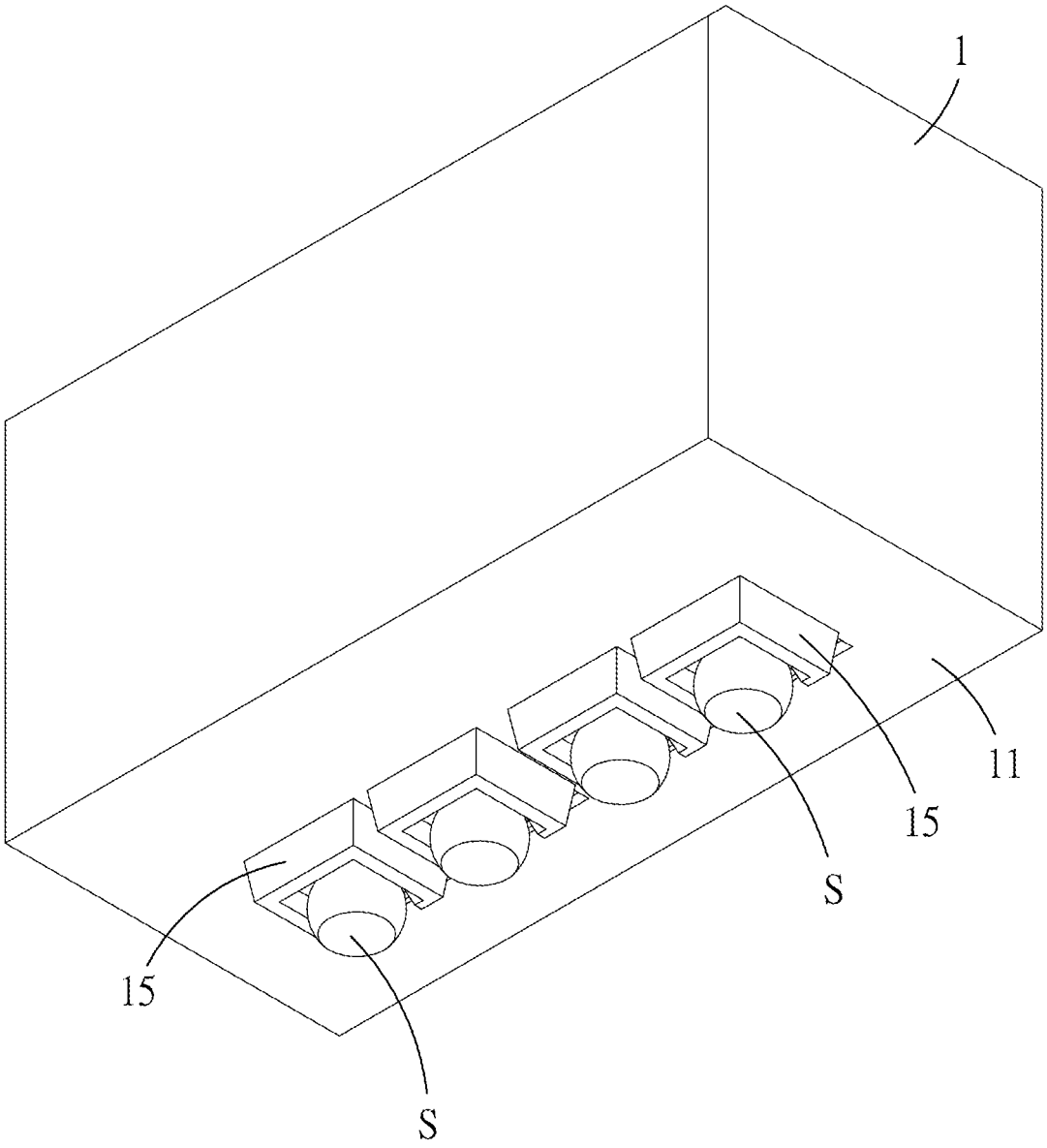
FIG. 14 is a perspective view of FIG. 13 from another angle.
Figure 15:
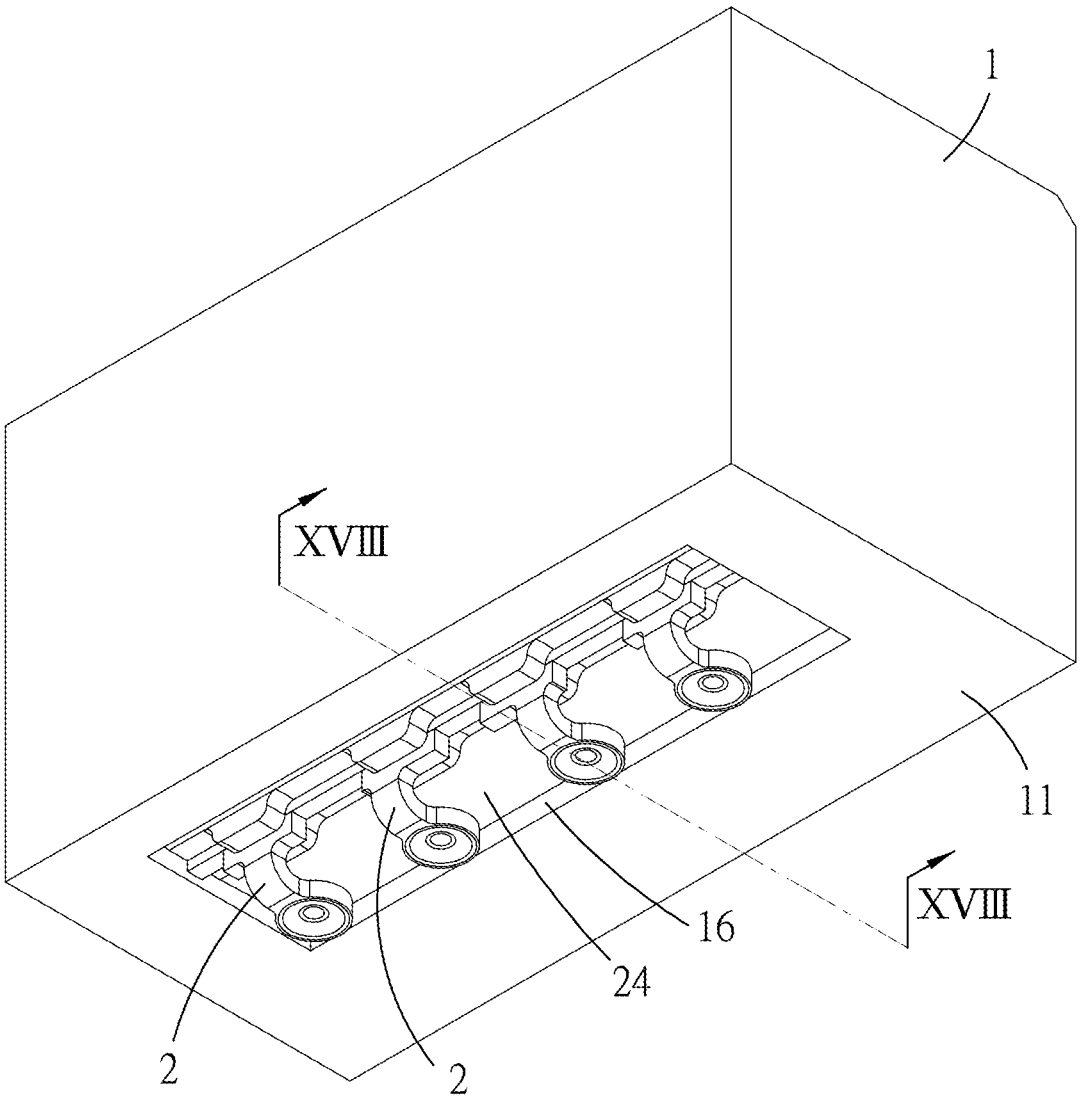
FIG. 15 is a partial perspective view of a third embodiment of the receptacle connector of the electrical connection device of the present disclosure.
Figure 16:
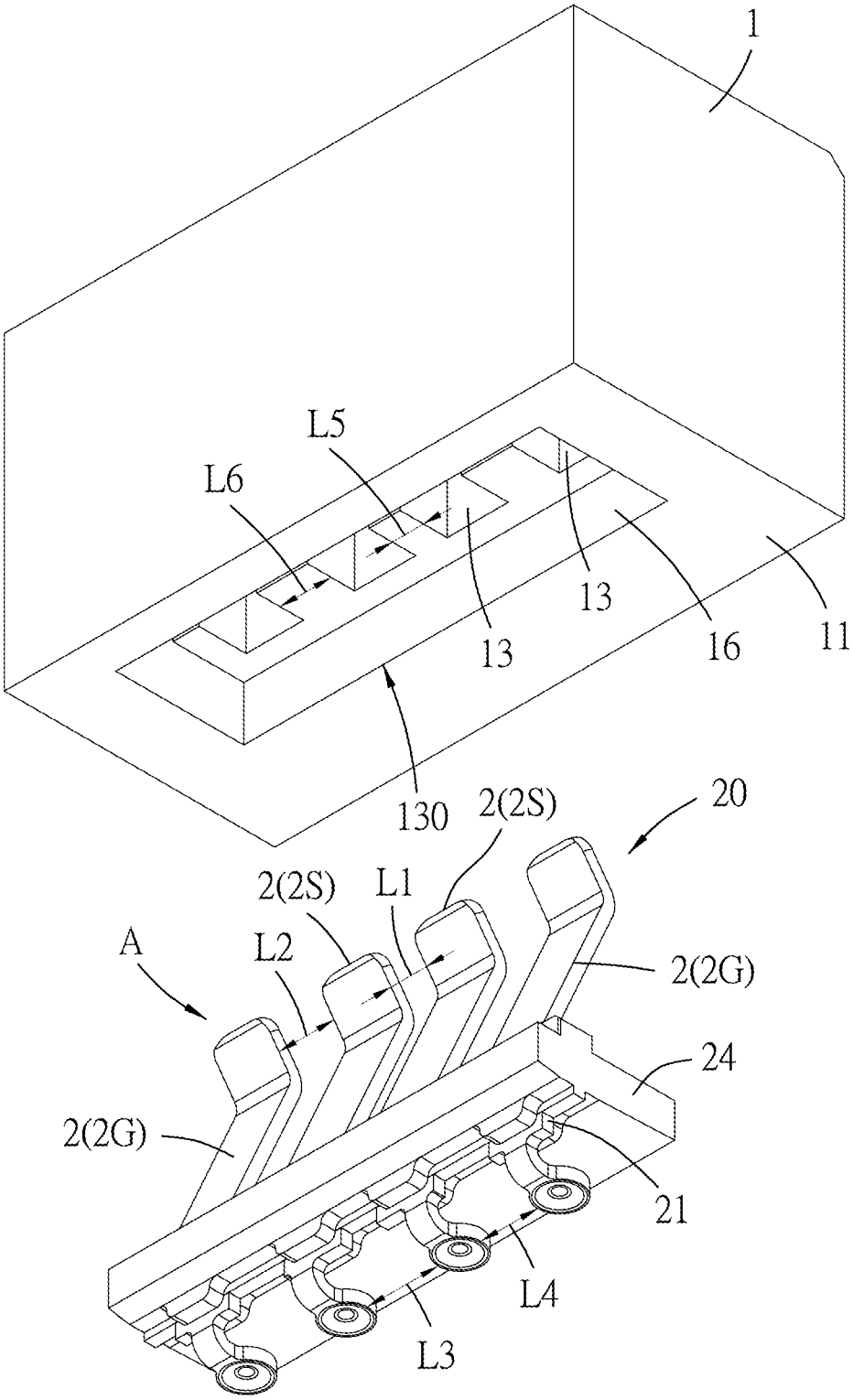
FIG. 16 is a perspective exploded view of FIG. 15.
Figure 17:
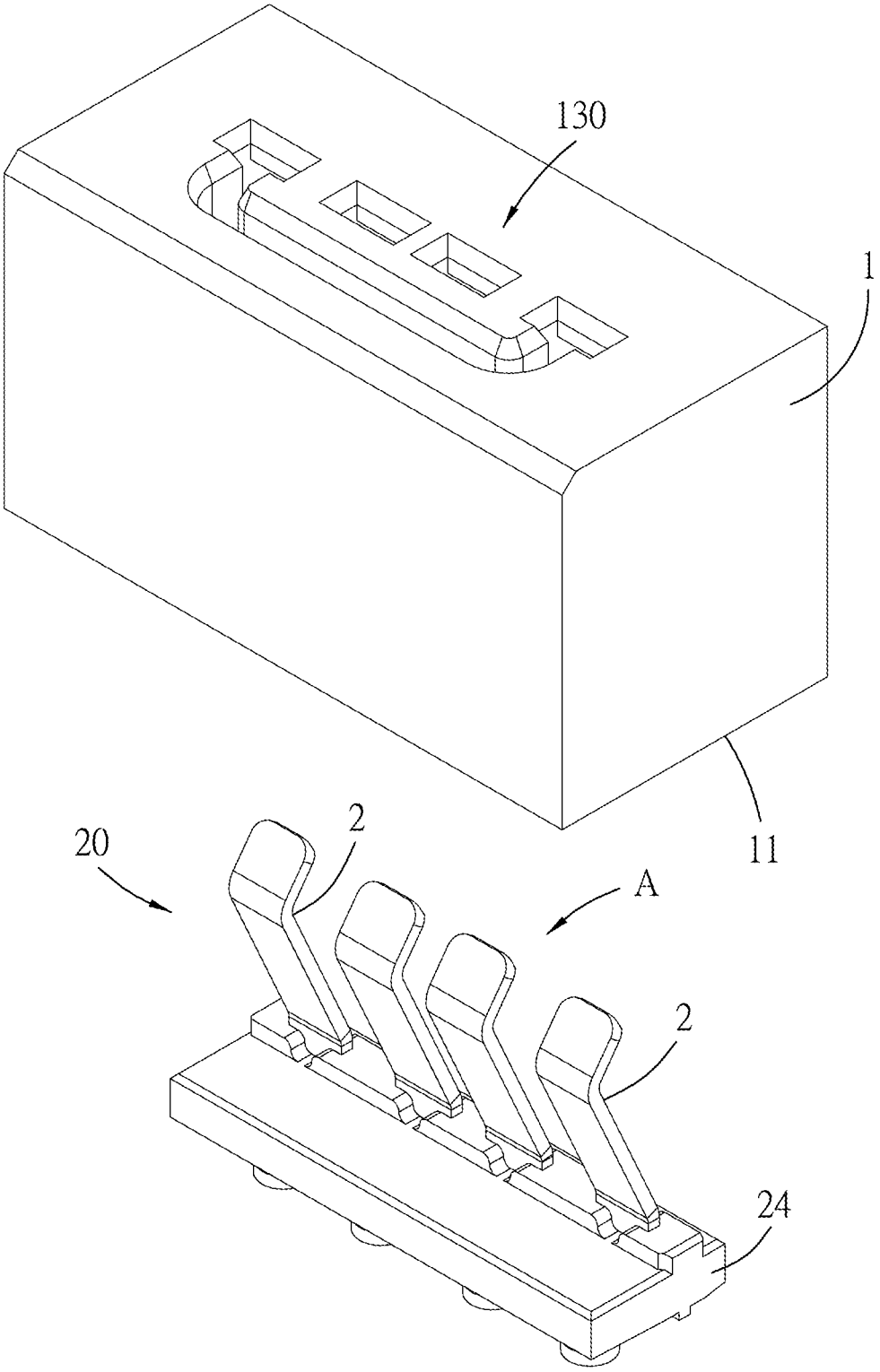
FIG. 17 is a perspective view of FIG. 16 from another angle.
Figure 18:
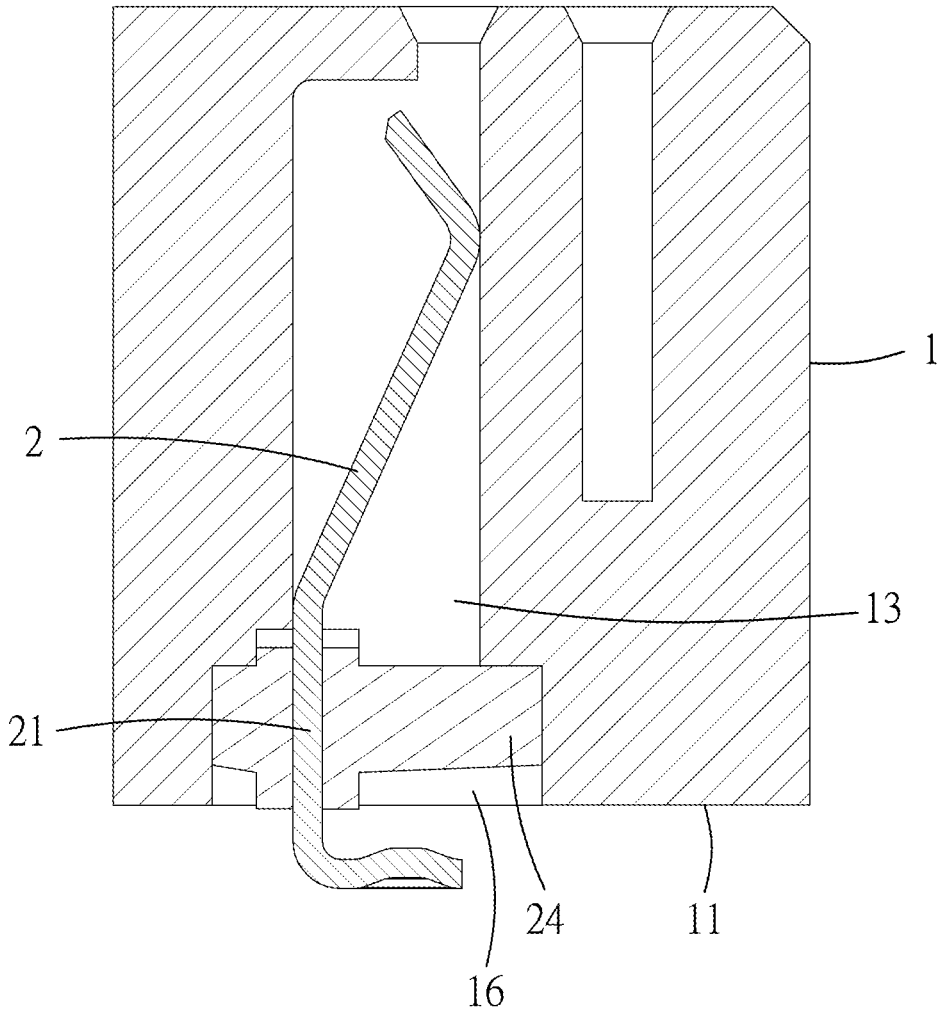
FIG. 18 is a cross sectional view taken along a line XVIII-XVIII of FIG. 15.

Referring to FIG. 13 and FIG. 14, a second embodiment of the electrical connection device of the present disclosure differs from the first embodiment in that, in the second embodiment, the receptacle housing 1 further has a plurality of positioning walls 15 which protrude from the bottom surface 11 respectively corresponding to the plurality of terminal grooves 13, each positioning wall 15 is provided along a circumferential side of the tail segment 23 of the corresponding receptacle terminal 2 and is used to position the tin ball S, which is convenient to provide the tin ball S and perform a soldering operation.

Referring to FIG. 15 to FIG. 18, a third embodiment of the electrical connection device of the present disclosure differs from the first embodiment in that, in the third embodiment, each receptacle terminal group A is provided to an insulative base 24 to form a terminal block 20, and the fixed segment 21 of each receptacle terminal 2 is fixed to the insulative base 24, and each terminal groove group 130 of the receptacle housing 1 further includes a receiving groove 16 which is recessed from the bottom surface 11 and is communicated with the terminal grooves 13, the receiving groove 16 is used to provide the insulative base 24 therein. In the third embodiment, each terminal block 20 is formed by insert molding.

However, the above description is only for the embodiments of the present disclosure, and it is not intended to limit the implementing scope of the present disclosure, and the simple equivalent changes and modifications made according to the claims and the contents of the specification are still included in the scope of the present disclosure.

What is claimed is:

1. An electrical connection device, comprising:

a receptacle connector comprising:

a receptacle housing having a bottom surface, a top surface opposite to the bottom surface and a plurality of terminal grooves extending from the bottom surface toward the top surface, a groove wall defining each terminal groove comprising a first side wall portion and a second side wall portion which face each other and a top wall portion which extends from the first side wall portion toward the second side wall portion, and the top wall portion and the second side wall portion being spaced apart from each other to allow the terminal groove to form an insertion opening portion exposed on the top surface, and a plurality of receptacle terminals respectively provided in the plurality of terminal grooves, each receptacle terminal having a fixed segment which is fixed to the receptacle housing and is close to the bottom surface and the first side wall portion, an elastic segment which extends obliquely and upwardly from a top end of the fixed segment, then is folded back and extends obliquely and upwardly toward the top wall portion to a tip end of the elastic segment, and a tail segment which extends from a bottom end of the fixed segment toward the second side wall portion, the tip end of the elastic segment being positioned below the top wall portion, the elastic segment having a contact portion which is formed at a position where the elastic segment is folded back and presses against the second side wall portion and a guiding surface which is positioned between the contact portion and the tip end of the elastic segment and is positioned below the insertion opening portion.

2. The electrical connection device of claim 1, wherein the receptacle housing further has a plurality of positioning walls which protrude from the bottom surface respectively corresponding to the plurality of terminal grooves, each positioning wall is provided along a circumferential side of the tail segment of the correspond receptacle terminal.

3. The electrical connection device of claim 1, wherein the tail segment has a soldering surface which faces downwardly and is used to be soldered with a solder.

4. The electrical connection device of claim 3, wherein the soldering surface is a concave arc surface and the solder is a tin ball, the soldering surface and a surface shape of the tin ball are matched with each other.

5. The electrical connection device of claim 1, wherein in each receptacle terminal, a width of the fixed segment is larger than a width of the tail segment, and the tail segment extends from a middle of the bottom end of the fixed segment, the fixed segment has two notches which are recessed inwardly from the bottom end of the fixed segment respectively correspondingly to two sides of the tail segment.

6. The electrical connection device of claim 1, wherein the second side wall portion has an inner taper segment, and the contact portion presses against the second side wall portion above the inner taper segment closer to the top surface than to the bottom surface.

7. The electrical connection device of claim 1, wherein the electrical connection device further comprises a plug connector which is used to mate with the receptacle connector, the plug connector comprises a plug housing and a plurality of plug terminals provided to the plug housing, the plurality of plug terminals and the plurality of receptacle terminals correspond to each other, the insertion opening portion of the receptacle connector is used to allow the plug terminal to insert therein to limit the plug terminal, so that in an inserting process of the plug terminal, a tip end of the plug terminal pushes the guiding surface of the corresponding receptacle terminal to make the contact portion of the corresponding receptacle terminal move toward a direction away from the second side wall portion, in turn make the contact portions of the corresponding receptacle terminal abut against the plug terminal.

8. The electrical connection device of claim 7, wherein the plurality of plug terminals are divided into multiple plug terminal groups, each plug terminal group is composed of three plug terminals, two plug terminals of the three plug terminals are signal terminals and another one plug terminal of the three plug terminal is a ground terminal, the ground terminal has two guiding connection portions which are respectively positioned at two sides of the two signal terminals and a connecting portion which connects the two guiding connection portions, the plurality of receptacle terminals are divided into multiple receptacle terminal groups which respectively correspond to the multiple plug terminal groups, each receptacle terminal group is composed of four receptacle terminals arranged side by side, two receptacle terminals positioned in a middle of the four receptacle terminals respectively mate with the two corresponding signal terminals and two receptacle terminals positioned at two sides of the four receptacle terminals respectively mate with the two guiding connection portions of the corresponding ground terminal, and the plurality of terminal grooves are divided into multiple terminal groove groups corresponding to the multiple receptacle terminal groups, the receptacle housing further has multiple insertion grooves respectively provided corresponding to the multiple terminal groove groups to allow the connecting portions of the ground terminals of the multiple receptacle terminal groups to insert therein respectively.

9. The electrical connection device of claim 1, wherein the second side wall portion has an inner taper segment which is positioned below the contact portion and extends to the bottom surface.

10. The electrical connection device of claim 1, wherein the plurality of receptacle terminals are divided into multiple receptacle terminal groups, each receptacle terminal group is composed of four receptacle terminals arranged side by side, two receptacle terminals positioned at a middle of the four receptacle terminals are signal terminals, and two receptacle terminals respectively positioned at outer sides of the four receptacle terminals are ground terminals, the elastic segments of the two signal terminals in each receptacle terminal group are spaced apart from each other by a first distance, the elastic segment of the signal terminal and the elastic segment of the ground terminal in the signal terminal and the ground terminal which are adjacent to each other in each receptacle terminal group are spaced apart from each other by a second distance, and the first distance is smaller than the second distance, the tail segments of the two signal terminals in each receptacle terminal group are spaced apart from each other by a third distance, the tail segment of the signal terminal and the tail segment of the ground terminal in the signal terminal and the ground terminal which are adjacent to each other in each receptacle terminal group are spaced apart from each other by a fourth distance, and the third distance is larger than the fourth distance.

11. The electrical connection device of claim 1, wherein the plurality of receptacle terminals are divided into multiple receptacle terminal groups, each receptacle terminal group is composed of four receptacle terminals arranged side by side, two receptacle terminals positioned at a middle of the four receptacle terminals are signal terminals, and two receptacle terminals respectively positioned at outer sides of the four receptacle terminals are ground terminals, the plurality of terminal grooves are divided into multiple terminal groove groups, each terminal groove group is composed of four terminal grooves arranged side by side and correspondingly receives one of the multiple receptacle terminal groups, the two terminal grooves in each terminal groove group which are used to respectively receive the two signal terminals of the corresponding receptacle terminal group are spaced apart from each other by a fifth distance, the two terminal grooves in each terminal groove group which are used to receive the signal terminal and the ground terminal which are adjacent to each other in the corresponding receptacle terminal group are spaced apart from each other by a sixth distance, and the fifth distance is smaller than the sixth distance.

12. An electrical connection device comprising:

a receptacle connector comprising:

a receptacle housing having a bottom surface, a top surface opposite to the bottom surface and multiple terminal groove groups, each terminal groove group comprising a receiving groove which is recessed from the bottom surface and terminal grooves which are communicated with the receiving groove and extend toward the top surface, a groove wall defining each terminal groove comprising a first side wall portion and a second side wall portion which face each other and a top wall portion which extends from the first side wall portion toward the second side wall portion, and the top wall portion and the second side wall portion being spaced apart from each other to allow the terminal groove to form an insertion opening portion exposed on the top surface, and multiple terminal blocks respectively provided in the multiple terminal groove groups, each terminal block comprising an insulative base and receptacle terminals, the insulative base being provided to the receiving groove of the corresponding terminal groove group, each receptacle terminal being provided corresponding to one of the terminal grooves and having a fixed segment which is fixed to the insulative base and is close to the first side wall portion, an elastic segment which extends obliquely and upwardly from a top end of the fixed segment, then is folded back and extends obliquely and upwardly toward the top wall portion to a tip end of the elastic segment, and a tail segment which extends from a bottom end of the fixed segment toward the second side wall portion, the tip end of the elastic segment being positioned below the top wall portion, the elastic segment having a contact portion which is formed at a position where the elastic segment is folded back and presses against the second side wall portion and a guiding surface which is positioned between the contact portion and the tip end of the elastic segment and is positioned below the insertion opening portion.

13. The electrical connection device of claim 12, wherein the tail segment has a soldering surface which faces downwardly and is used to be soldered with a solder.

14. The electrical connection device of claim 13, wherein the soldering surface is a concave arc surface and the solder is a tin ball, the soldering surface and a surface shape of the tin ball are matched with each other.

15. The electrical com1ection device of claim 12, wherein in each receptacle terminal, a width of the fixed segment is larger than a width of the tail segment, and the tail segment extends from a middle of the bottom end of the fixed segment, the fixed segment has two notches which are recessed inwardly from the bottom end of the fixed segment respectively correspondingly to two sides of the tail segment.

16. The electrical connection device of claim 12, wherein the second side wall portion has an inner taper segment, and the contact portion presses against the second side wall portion above the inner taper segment closer to the top surface than to the bottom surface.

17. The electrical connection device of claim 12, wherein the electrical connection device further comprises a plug connector which is used to mate with the receptacle connector, the plug connector comprises a plug housing and a plurality of plug terminals provided to the plug housing, the plurality of plug terminals and the receptacle terminals correspond to each other, the insertion opening portion of the receptacle connector is used to allow the plug terminal to insert therein to limit the plug terminal, so that in an inserting process of the plug terminal, a tip end of the plug terminal pushes the guiding surface of the corresponding receptacle terminal to make the contact portion of the corresponding receptacle terminal move toward a direction away from the second side wall portion, in turn make the contact portion of the corresponding receptacle terminal abut against the plug terminal.

18. The electrical com1ection device of claim 17, wherein the plurality of plug terminals are divided into multiple plug terminal groups, each plug terminal group is composed of three plug terminals, two plug terminals of the three plug terminals are signal terminals and another one plug terminal of the three plug terminals is a ground terminal, the ground terminal has two guiding connection portions which are respectively positioned at two sides of the two signal terminals and a connecting portion which connects the two guiding connection portions, the multiple terminal blocks respectively correspond to the multiple plug terminal groups, each terminal block has four receptacle terminals arranged side by side, two receptacle terminals positioned in a middle of the four receptacle terminals respectively mate with the two corresponding signal terminals and two receptacle terminals positioned at two sides of the four receptacle terminals respectively mate with the two guiding connection portions of the corresponding ground terminal, and each terminal groove group further has an insertion groove to allow the connecting portion of the corresponding ground terminal to insert therein.

19. The electrical connection device of claim 12, wherein each terminal block is formed by insert molding.

20. The electrical connection device of claim 12, wherein each terminal block has four receptacle terminals arranged side by side, two receptacle terminals positioned at a middle of the four receptacle terminals are signal terminals, and two receptacle terminals respectively positioned at outer sides of the four receptacle terminals are ground terminals, the elastic segments of the two signal terminals in each terminal block are spaced apart from each other by a first distance, the elastic segment of the signal terminal and the elastic segment of the ground terminal in the signal terminal and the ground terminal which are adjacent to each other in each terminal block are spaced apart from each other by a second distance, and the first distance is smaller than the second distance, the tail segments of the two signal terminals in each terminal block are spaced apart from each other by a third distance, the tail segment of the signal terminal and the tail segment of the ground terminal in the signal terminal and the ground terminal which are adjacent to each other in each terminal block are spaced apart from each other by a fourth distance, and the third distance is larger than the fourth distance.

21. The electrical connection device of claim 12, wherein each terminal block has four receptacle terminals arranged side by side, two receptacle terminals positioned at a middle of the four receptacle terminals are signal terminals, and two receptacle terminals respectively positioned at outer sides of the four receptacle terminals are ground terminals, each terminal groove group has four terminal grooves, the two terminal grooves in each terminal groove group which are used to respectively receive the two signal terminals of the corresponding terminal block are spaced apart from each other by a fifth distance, the two terminal grooves in each terminal groove group which are used to receive the signal terminal and the ground terminal which are adjacent to each other in the corresponding terminal block are spaced apart from each other by a sixth distance, and the fifth distance is smaller than the sixth distance.

* * * * *